US008783588B2

(12) United States Patent
Pape et al.

(10) Patent No.: US 8,783,588 B2
(45) Date of Patent: Jul. 22, 2014

(54) RECOVERY OF ALEURONE-RICH FLOUR FROM BRAN

(75) Inventors: Warner Travis Pape, Houston, TX (US); Ricardo Martin Ghisays Galindo, Barranquilla (CO)

(73) Assignees: Applied Milling Systems, Inc., Houston, TX (US); SuperBrix Internacional S.A., Barranquilla (CO)

( * ) Notice: Subject to any disclaimer, the term of this patent is extended or adjusted under 35 U.S.C. 154(b) by 427 days.

(21) Appl. No.: 13/293,254

(22) Filed: Nov. 10, 2011

(65) Prior Publication Data

US 2013/0119170 A1 May 16, 2013

(51) Int. Cl.
*B02C 9/04* (2006.01)

(52) U.S. Cl.
USPC ..... 241/9; 241/12; 241/19

(58) Field of Classification Search
CPC ..... B02C 7/184; B02C 9/00; B02C 9/02; B02C 9/04; B02C 11/08; B02C 19/0012
USPC ..... 241/6–13, 19
See application file for complete search history.

(56) References Cited

U.S. PATENT DOCUMENTS

| | | | | |
|---|---|---|---|---|
| 1,141,969 | A | 6/1915 | McFeely et al. | |
| 3,226,041 | A | 12/1965 | Graumann | |
| 4,746,073 | A | 5/1988 | Stone et al. | |
| 5,082,680 | A | 1/1992 | Tkac | |
| 5,186,968 | A | 2/1993 | Wellman | |
| 5,211,982 | A | 5/1993 | Wellman | |
| 5,390,589 | A | 2/1995 | Satake et al. | |
| 5,525,716 | A | 6/1996 | Olsen et al. | |
| 5,752,664 | A | 5/1998 | Satake et al. | |
| 5,846,591 | A | 12/1998 | Satake et al. | |
| 7,425,344 | B2 * | 9/2008 | Korolchuk et al. | 426/518 |
| 7,506,829 | B2 | 3/2009 | Tribuzio et al. | |
| 7,780,101 | B2 | 8/2010 | Bohm et al. | |
| 2002/0037331 | A1 | 3/2002 | Hwang et al. | |
| 2003/0175384 | A1 | 9/2003 | Bohm et al. | |
| 2006/0177529 | A1 | 8/2006 | Laux et al. | |
| 2007/0122537 | A1 | 5/2007 | Arlotti et al. | |
| 2008/0089996 | A1 | 4/2008 | Yokoyama et al. | |
| 2010/0078361 | A1 | 4/2010 | Bohm et al. | |
| 2010/0203195 | A1 | 8/2010 | Didion et al. | |
| 2011/0256207 | A1 | 10/2011 | Arndt et al. | |

OTHER PUBLICATIONS

International Search Report and Written Opinion for corresponding International Application No. PCT/US 12/63968 filed Nov. 7, 2012.

* cited by examiner

*Primary Examiner* — Mark Rosenbaum
(74) *Attorney, Agent, or Firm* — Stephen S. Hodgson

(57) ABSTRACT

A bran finishing process in grain milling employs a milling machine in which bran that contains some endosperm, including aleurone, is fed into an annular milling chamber defined on an inner side by an eccentric cylindrical rotor and on an outer side by a frame assembly that includes perforated screens and abrasive surfaces. Longitudinal lobes protrude radially from the rotor. The lobes compress the bran as they rotate, while the lesser diameter of the rotor between lobes allows the bran to decompress, causing bran particles to rub together for detaching endosperm from the bran by friction forces. Bran particles also rub against the abrasive surfaces for scraping endosperm off the bran. Air flows through the milling chamber and carries the endosperm through the perforated screens, while the bran particles are discharged without passing through the screens.

36 Claims, 4 Drawing Sheets

RECOVERY OF ALEURONE-RICH FLOUR FROM BRAN

BACKGROUND OF THE INVENTION

1. Field of the Invention

This present invention pertains to the production of flour from cereal grains and to the production of high-starch feed stocks for conversion to bio-fuels, and more particularly to a bran-finishing process that uses a milling machine for detaching flour from bran using compressive and/or abrasive forces.

2. Description of the Related Art

Cereal grains are consumed throughout the world as a staple food, which often serves as a primary source for carbohydrates and also as a feedstock for the production of bio-fuels such as ethanol. Cereal grains have an embryo or germ surrounded by endosperm that is in turn surrounded by bran layers. The endosperm has a high starch content, which makes cereal grains a good source of food for humans. Cereal grains include rye, barley, wheat, which includes durum or durum wheat, hard wheat, and soft wheat, and triticale, which is a hybrid of rye and wheat.

FIG. 1 shows a kernel 10 of wheat in cross-section as an example of a cereal grain. Kernel 10 comprises an outer bran coat 12 surrounding and protecting an inner portion of endosperm 14, which surrounds or is adjacent to an embryo or germ portion 16. FIG. 1A shows the cross-section of the outer bran coat 12 in greater detail. Outer bran coat 12 is adjacent to endosperm 14. Outer bran coat 12 has an innermost layer of aleurone 18 in contact with endosperm 14. A seed coat 20 of nucellar tissue covers the aleurone layer 18. A layer of testa 22 covers the seed coat nucellar tissue 20, and pericarp 24 covers the testa 22. U.S. Pat. No. 5,082,680, issued to Tkac, and U.S. Pat. No. 5,846,591, issued to Satake et al., which are incorporated by reference, provide additional detail on the composition of a grain of wheat. U.S. Pat. No. 5,211,982, issued to Wellman and incorporated by reference, provides background information on milling wheat and producing a milled product that contains aleurone cell wall fragments.

Traditional methods of cereal milling involve conditioning the kernel by increasing its moisture content and then subjecting the kernel to several successive stages of impact or crushing actions intended to first dislodge the germ and break the whole kernel into several pieces, then further reduce these pieces into smaller particles until endosperm of the desired particle size is obtained. During these impact and crushing actions, bran particles tend to stay whole, while germ tends to flatten, producing relatively larger particles, and the endosperm is scraped from the bran particles and tends to shatter, producing relatively smaller particles. Between the impact or crushing stages, sifting and/or density separation is employed to isolate the bran and the germ from the endosperm.

Once the germ and the bran have been isolated from the endosperm, the germ can be separated from the bran using rollermilling, sifting and aspiration. The bran is then subjected to impact in an attempt to dislodge any endosperm particles that still cling to the bran, and these endosperm particles are then removed from the bran by screening. Inherent inefficiencies in this process for detaching endosperm from bran and the machinery used in recovering the endosperm from the bran limit the yield of endosperm that can be used for the production of flour or bio-fuel feedstock. A further drawback is that the aleurone, which is a largely colorless and nutrient-rich layer on the surface of the endosperm, is largely lost to the bran using conventional milling technologies. Aleurone is valued for the nutrients and dietary fiber that it contains, but aleurone adheres tightly to the bran and stays with the bran.

In conventional milling of wheat, as much endosperm and aleurone has been recovered from bran as practical by passing grains of wheat through a pair of rollers, which crush the grains of wheat, followed by sifting for particle size classification. This is referred to as a break, and larger particles are passed through another set of rollers, which is referred to as a second break, followed by sifting for size classification. This process can be repeated for as many breaks as economically practical, and a typical mill may employ four, five or six breaks. The process continues into a bran finishing step and a shorts finishing step.

FIG. 2 illustrates a conventional prior art bran finishing machine 30, which is shown as a partial cross-section of an end view of a side elevation. Bran finishing machine 30 has a housing 32, which is supported by legs (not shown). Housing 32 has a length defined by opposing ends, and a shaft-support with a bearing (not shown) is located on each end. A shaft 34 extends essentially the length of the housing 32 and is received in the shaft supports. A motor (not shown) rotates shaft 34 using a belt (not shown). A plurality of hubs 36 is received on and fixed to shaft 34, although only one hub 36 is shown in the cross-section. Each hub 36 has spokes 36*a*, 36*b*, 36*cf*, 36*d* and 36*e* that extend radially outwardly from shaft 34. Beaters 38*a*, 38*b*, 38*c*, 38*d* and 38*e* are received on spokes 36*a*, 36*b*, 36*cf*, 36*d* and 36*e*, respectively. The spokes shall be referred to collectively as spokes 36, and the beaters shall be referred to collectively as beaters 38. The beaters 38 are plates that extend essentially the length of the housing 32. Housing 32 has brackets 32*a* and 32*b*, and a cover 40 having brackets 40*a* and 40*b* is bolted to brackets 32*a* and 32*b*, respectively. Cover 40 extends the length of the housing 32 and is open along an upper longitudinal portion, which gives cover 40 a trough shape. In the transverse cross-section shown in FIG. 2, cover 40 has a circular shape and is enclosed along a lower portion of about 220 degrees, leaving an open upper portion of about 140 degrees. An upper portion 32*c* of housing 32, housing sidewall 32*d* and 32*e* (not shown), bracket flanges 32*a* and 32*b* and cover 40 define a milling chamber 42, which is an enclosed space. Housing 32 has a discharge hopper 32*f* below cover 40. Cover 40 is perforated, which provides a plurality of cover holes (not shown) that extend radially through cover 40. The cover holes provide pathways for flour to pass from inside cover 40 to the inside of discharge hopper 32*f*. An inlet opening 32*g* is referred to as a loading spout and provides a pathway for feeding a cereal grain, such as wheat, into milling chamber 42. An outlet opening (not shown) through housing 32 on the end opposite inlet opening 32*g* provides a pathway for discharging bran from milling chamber 42.

In operating bran finisher 30, bran is fed continuously into milling chamber 42 through inlet opening 32*g*. The bran has aleurone attached to an inside layer of the bran and endosperm attached to the aleurone and clinging to the bran. Milling chamber 42 remains partially filled. Shaft 34 is rotated by the motor, which causes beaters 38 to pass through the bran. Beaters 38 hit, strike and collide with the bran and thus impact the bran. Beaters 38 are shaped to push the bran toward the outlet opening. As beaters 38 impact the bran, a portion of the endosperm is removed from the bran, and that portion of the endosperm passes through the cover holes and into the discharge hopper, where it is recovered for further processing into flour. The bran is moved along by the beaters 38 to the outlet opening. A plurality of diverting paddles 44 can be rotated with an adjusting screw 44*a* for controlling the length of time that the bran is in the milling chamber 42.

Although a portion of the endosperm can be removed from the bran by impact forces applied by the bran finisher 30, the aleurone layer tends generally to remain adhered to the bran. Consequently, the aleurone layer, which has good nutritional value, is usually lost with the bran and is not recovered for use in flour.

It is desirable to recover the nutrient-rich aleurone layer from the bran for improving flour yield and the nutritional value of the flour, and processes have been developed for recovering aleurone from bran. U.S. Pat. No. 4,746,073, issued to Stone et al. and incorporated by reference, describes a process for recovering aleurone from wheat bran, which includes hammer-milling the wheat bran, which is believed to detach the aleurone from the bran and to break the bran and aleurone into small particles. The mixture of bran and aleurone particles are classified to achieve a desired particle size range. Particles of the desired particle size range are electrostatically charged and then fractionated by the differential of their electrical charges, thereby separating the aleurone from the bran for recovering some portion of the aleurone.

U.S. Patent Application Pub. No. 2003/0175384, which lists Bohm et al. as inventors and which is incorporated by reference, is directed to extracting aleurone from bran. A wet method is described that uses enzymes to weaken the adhesion of aleurone to bran. A dry method is described that uses a rolling mill, a centrifugal impact mill and/or a jet mill for detaching aleurone from bran and for grinding and/or breaking the aleurone and bran into a mixture of small particles. The mixture is separated into its aleurone and bran components by air classification and sifting and by grading or sorting in an electrical field, all of which can be repeated to obtain a desired level of enrichment of aleurone cells.

U.S. Patent Application Pub. No. 2006/0177529, which lists Laux et al. as inventors, describes a process for recovering aleurone from bran that has aleurone components and bran components. The aleurone components are detached from the non-aleurone components using mechanical-abrasive means or biological-enzymatic means as described in U.S. Patent Application Pub. No. 2003/0175384, which forms a mixture composed of aleurone and non-aleurone components. The aleurone components are separated and recovered from the mixture using electrostatic sorting. Water is added to the aleurone components to provide a moisture content of 10-20 wt %, followed by superfine milling using a grinding roll mill in which rolls are pressed together while revolving at different speeds.

In these prior efforts to recover aleurone, which is adhered to bran initially, the aleurone and bran are believed to have been generally broken down into a mixture of fine particles. Separation of the aleurone components from the non-aleurone components in the mixture required significant capital and operating expenditures for equipment such as electrostatic chargers, air classifiers, sifters, sieves and sorters.

SUMMARY OF THE INVENTION

The present invention provides a process for recovering flour or endosperm, particularly aleurone, from bran by processing a cereal grain, preferably wheat, to produce flour and a first bran stream, where the first bran stream comprises bran and an aleurone-rich flour adhered to the bran; feeding the first bran stream to a milling machine; recovering an aleurone-rich flour product from the milling machine; and recovering a second bran stream from the milling machine. The milling machine has an outer housing, and an elongated shaft is received in the housing. A rotor, which has a length and a radial-outermost surface along its length, is fixed to the shaft. A frame assembly, which has a plurality of holes, is received in the housing. A milling chamber is defined between the radial-outermost surface of the rotor and the frame assembly, and the radial-outermost surface of the rotor provides a boundary wall for the milling chamber. In operation, the shaft rotates thereby rotating the rotor, while the first bran stream is fed through an inlet opening into the milling chamber. Aleurone-rich flour is dislodged from the bran and recovered through the plurality of holes in the frame assembly and through a discharge outlet. A second bran stream is recovered through another discharge outlet, and preferably, much of the aleurone-rich flour is removed from the first bran stream to form the second bran stream.

The frame assembly preferably has a generally cylindrical shape, preferably with a polygonal transverse cross-section, and a radial-innermost surface, which preferably surrounds the rotor. The milling chamber is preferably an annular space defined between the radial-outermost surface of the rotor and the radial-innermost surface of the frame assembly. The rotor is preferably eccentric such that the radial thickness of the annular milling chamber is not constant. Milling action preferably occurs due to rotation of the rotor causing a compression and then a decompression on the bran stream for rubbing bran particles together and detaching the endosperm, including aleurone, from the bran. The milling chamber is preferably partially defined by abrasive surfaces for scraping endosperm, particularly aleurone, from the bran. The process preferably includes having a flow of air through the milling chamber for assisting the removal of endosperm out of the milling chamber through the plurality of holes in the frame assembly and for cooling the product and machine components. The size of the holes in the frame assembly is preferably too small for bran particles to pass through, but large enough for particles of endosperm to pass through.

In one embodiment, the present invention provides a process for finishing bran. The process includes the steps of processing grain; recovering aleurone-rich bran, which has aleurone components adhered to bran components, from the grain; processing the aleurone-rich bran in a milling machine; separating the aleurone components from the bran components with the milling machine; and recovering the aleurone components and the bran components from the milling machine as separate product streams. The milling machine has a rotor assembly, which has a length, an irregular cylindrical shape and a radial outermost surface along its length; a basket assembly, which has an open central longitudinal portion in which the rotor assembly is received and a screen with openings; and a milling chamber is defined between the radial outermost surface of the rotor assembly and the basket assembly for receiving the aleurone-rich bran. The milling machine detaches a portion of the aleurone components from the bran components by compressing the aleurone-rich bran and/or by scraping the aleurone components off of the bran components while the aleurone-rich bran is in the milling chamber. The aleurone components are separated from the bran components by passing the aleurone components through the openings in the screen in the basket assembly, after which the aleurone components are recovered. The bran components are recovered from the milling machine without passing a significant amount of the bran components through the openings in the screen in the basket assembly.

In another embodiment, the present invention provides a process for reducing the amount of endosperm, including aleurone, in a bran stream recovered from a cereal-grain milling process, where the bran stream includes bran components and endosperm components adhered to the bran components. The bran stream is fed into a milling machine that has a rotor unit and a screen unit surrounding the rotor unit, where the rotor unit has an irregular cylindrical shape and a radial-outermost surface A milling chamber, which has an irregular annular shape, is defined between the screen unit, which has a plurality of holes, and the radial-outermost surface of the rotor unit. A portion of the endosperm components are detached from the bran components inside the milling chamber by squeezing the bran stream between the rotor unit and the screen unit and/or by scraping the endosperm components off of the bran components, thereby forming a mixture that includes an endosperm product and a bran product. The endosperm product is recovered from the milling chamber through the plurality of holes in the screen unit; and the bran product is recovered from the milling chamber without passing through the plurality of holes in the screen unit.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

Figure 1:
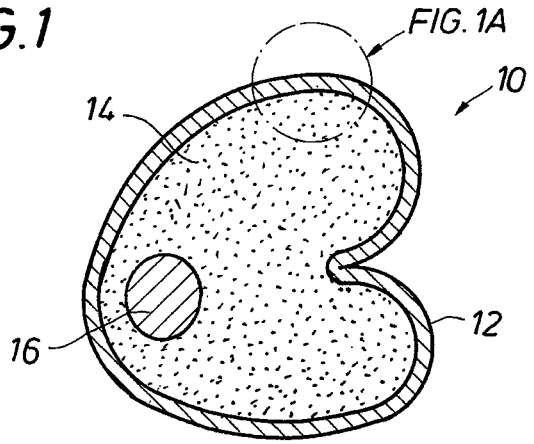
FIG. 1 is a transverse cross-section of a grain of wheat.
Figure 1A:
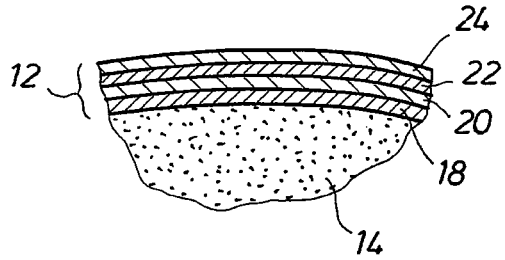
FIG. 1A is an expanded view of the portion 1A of the grain of wheat in FIG. 1.

A process is provided for recovering aleurone-rich endosperm from a bran fraction produced by crushing and impact actions employed by a traditional cereal milling process. Bran from a traditional cereal milling process contains a significant, although small, amount of endosperm attached and/or clinging to and/or mixed with the bran. In particular, a layer of aleurone is attached to the bran, and the present invention provides a process for detaching the aleurone from the bran and for recovering the aleurone-type endosperm and additional endosperm from the bran in a single processing step. A stream comprising aleurone-type endosperm, additional endosperm and a small portion of small bran particles is recovered and passed through a vibrosifter to make a final separation, which yields an aleurone-rich flour stream. The process employs friction and abrasive forces rather than impact forces to separate endosperm particles from the bran particles to which they are otherwise attached as a result of the traditional milling operations. In one embodiment, a milling machine applies combined friction and abrasive forces to bran particles confined within a perforated cylinder with the result that endosperm particles are dislodged from the bran particles and removed through perforations in the cylinder, where they are subsequently collected either pneumatically or mechanically.

A prior art process for milling rice uses a milling machine that has a milling chamber defined as a space between an outer round metal screen having slotted perforations and an inner round rotor. The rotor has an abrasive material and/or at least two blades or lobes aligned longitudinally along the outer edge of the rotor. Rotation of the rotor causes the grain within the chamber to rotate in the same direction as the rotor. A transverse cross-section of the outer screen has a polygonal shape, and the screen has either slotted or round perforations. In such machines bran and germ are either removed by scraping from the endosperm through contact with abrasive surfaces or by the friction action caused by individual grains rubbing against each other. The bran and germ are then removed from the milling chamber though the perforations in the outer screen. This type of milling machine has also been used in wheat and corn milling, which is described in the following patent documents: U.S. Pat. Nos. 5,390,589; 5,752,664; 5,186,968 and 5,082,680 and International Patent Application Pub. Nos. WO 2004028694 and WO 2002015711.

While friction and abrasive actions have previously been used before in the milling of cereal grains, in every application they have been used to remove bran through the perforations in the outer screen, leaving a larger portion composed of endosperm within the milling chamber. The present invention, in contrast, introduces bran produced from conventional milling processes into the milling chamber and extracts endosperm through the perforations in the outer screen, leaving the larger bran portion within the chamber. The inventors believe that such an application of this type of machine has not been previously practiced.

Figure 2:
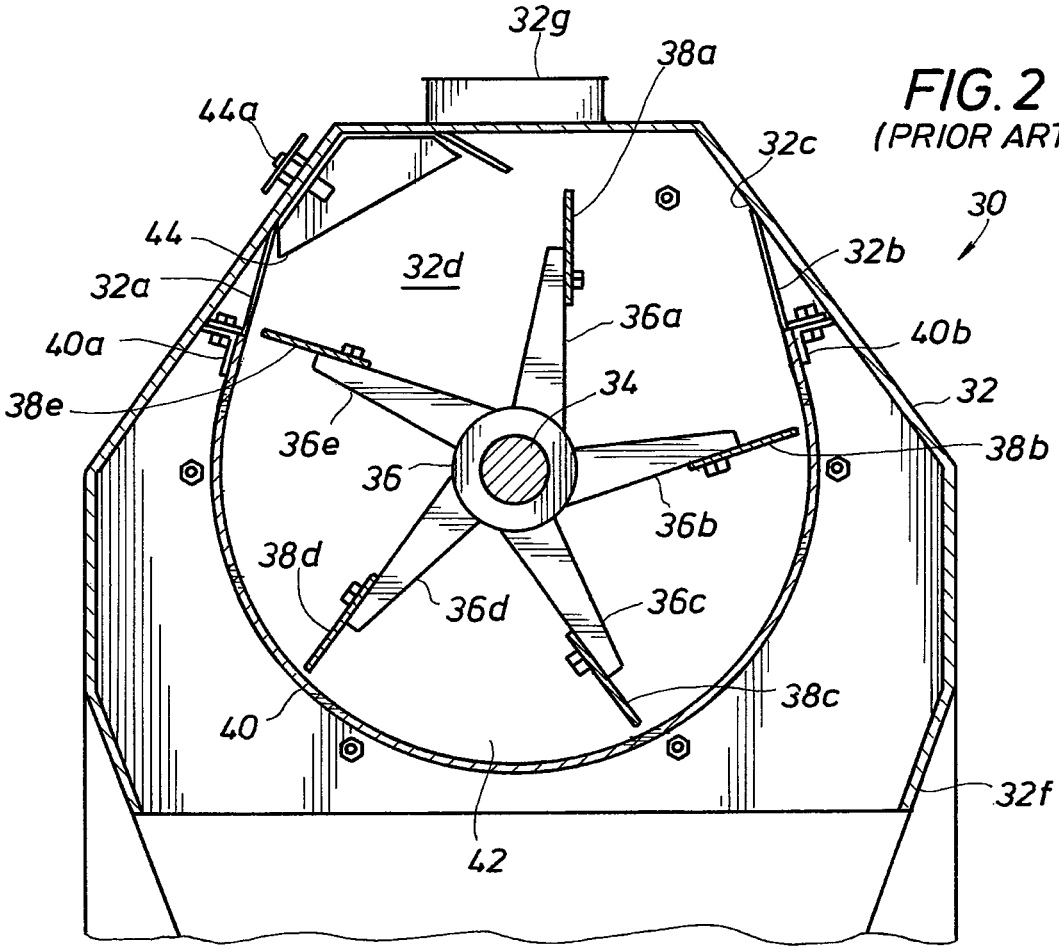
FIG. 2 (PRIOR ART)
FIG. 2 is a cross-section of a side elevation of a prior art bran finisher.
Figure 3:
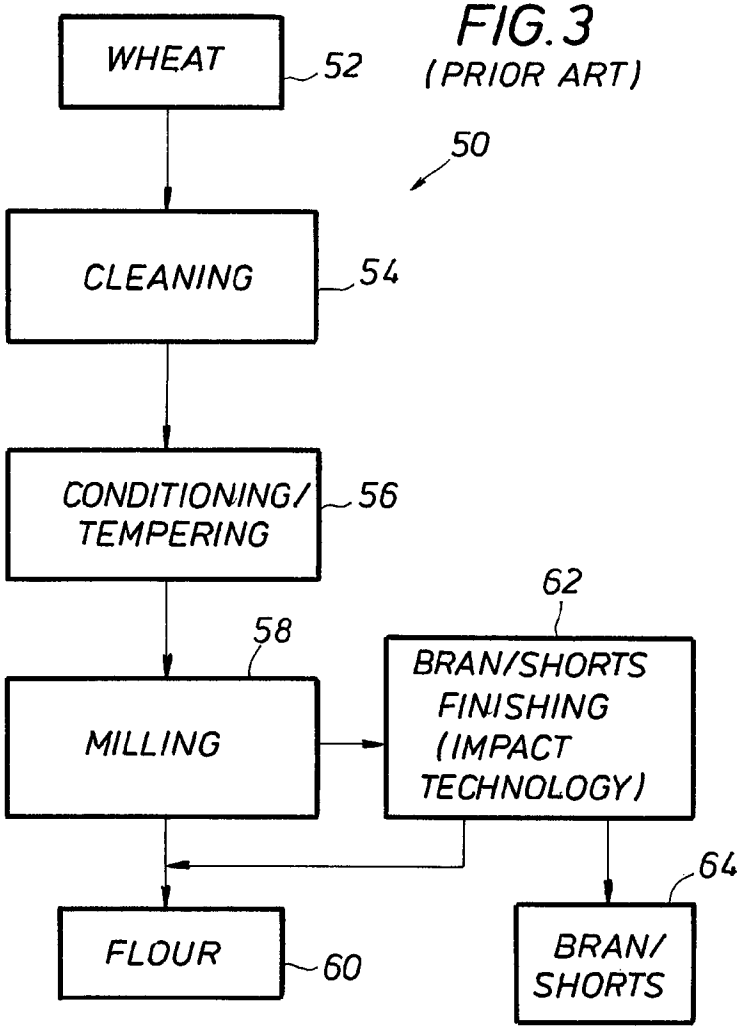
FIG. 3 (PRIOR ART)
FIG. 3 is a process flow diagram for a prior art wheat milling process.

FIG. 3 is a process flow diagram for a conventional, prior art wheat milling process 50. Wheat 52 is fed to a cleaning process step 54, where dirt and debris is removed from the wheat. After the wheat is cleaned, it is treated in a conditioning and tempering step 56. The treated wheat is then milled in a milling step 58. In milling step 58, endosperm and aleurone-type endosperm is detached from bran by passing grains of wheat through a pair of rollers, which crush the grains of wheat, followed by sifting for particle size classification. This is referred to as a break, and larger particles are passed through another set of rollers, which is referred to as a second break, followed by sifting for size classification. This process can be repeated for as many breaks as economically practical, and a typical mill may employ four, five or six breaks. The sifting, as well as other processes, separate endosperm from bran, and endosperm of a desired particle size range is recovered as flour in step 60. The bran is fed to bran and shorts finishers in step 62. The bran finisher 30 described with reference to FIG. 2 is typical of prior art bran finishing technology. In the bran/shorts finishing step 62, endosperm is dislodged from bran using impact technology and recovered as flour in step 60. Bran and shorts are recovered in a bran/shorts step 64. The prior art impact technology exemplified by the bran finisher described with reference to FIG. 2 relies to a great extent on beaters 38 hitting, smacking and beating bran in order to dislodge endosperm particles from bran particles.

Figure 4:
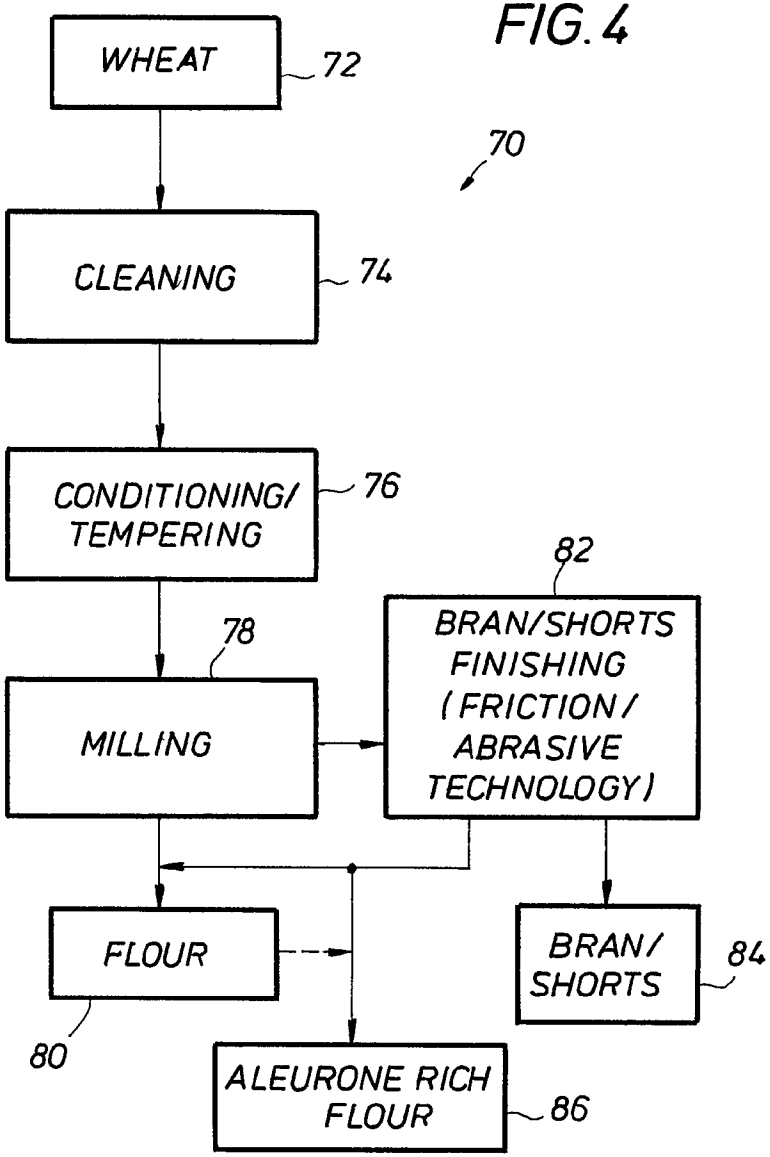
FIG. 4 is a process flow diagram for a wheat milling process, according to the present invention.

FIG. 4 is a process flow diagram for a wheat milling process 70, according to the present invention. Wheat 72 is fed to a cleaning process step 74, where dirt and debris is removed from the wheat. After the wheat is cleaned, it is treated in a conditioning and tempering step 76. The treated wheat is then milled in a milling step 78. Endosperm is detached from bran by passing grains of wheat through a pair of rollers, which crush the grains of wheat, followed by sifting for particle size classification, as was done in the prior art milling step 58. Flour is recovered in step 80. The milling process 70 of the present invention differs from the prior art milling process 50 primarily in an inventive bran/shorts finishing step 82. Friction and abrasive technology in inventive bran/shorts finishing step 82 replaces the impact technology described with reference to FIG. 2. After processing in bran/shorts finishing step 82, bran and shorts are recovered in bran/shorts step 84. Flour can be recovered in step 80, and an aleurone-rich flour is recovered in a step 86. With inventive milling process 70, a higher yield of flour can be obtained than has been typically obtained in prior art milling process 50. Further, a flour 86 is recovered in inventive milling process 70 that has a higher content of aleurone-type endosperm than is recovered in the prior art process 50. Aleurone has high levels of minerals and other nutrients as compared to non-aleurone endosperm. The aleurone-rich flour recovered in step 86 may have a higher value than the flour recovered in the prior art flour-recovery step 60 because aleurone-rich flour has the appearance and taste of a highly-refined flour, such as used for making white bread, while also having nutritional characteristics found in a less-refined flour, such as used for making brown, whole-wheat bread.

In one embodiment of the present invention, a cereal grain, preferably wheat, is cleaned and passed through a pair of rollers, which crush the grains of wheat. The wheat is sifted for classifying particles according to size. These steps are repeated a number of times in a series of breaks, typically four to six breaks, until a bran stream is produced. In conventional milling, this bran stream would be fed to the prior art bran finisher described with reference to FIG. 2. Most of the endosperm in the grain fed into the milling process has been removed from the bran stream, but the aleurone layer remains adhered to the bran particles in the bran stream, and additional endosperm is attached to the aleurone and/or mixed into the bran stream.

In the present invention, the prior art bran finisher described with reference to FIG. 2 is replaced by a different milling machine. The present invention provides a process in which bran obtained through traditional milling methods of impact and crushing is subsequently introduced, preferably using a force-feeding device such as an auger, into a milling chamber consisting of the annular space between a milling rotor, which is mounted on a central shaft and which is preferably eccentric, and an outer perforated cylinder, where the outer cylinder is polygonal in cross section. The perforation holes preferably do not have an elongated slot shape and are instead preferably circular and/or polygonal in shape and have a diameter of less than 5 mm, preferably less than 3 mm. The rotor is rotated by the central shaft, and the clearance between the radial tip of the rotor and a point on the outer perforated cylinder alternately increases and decreases several times during each rotation. The bran particles within the milling chamber, to which endosperm particles are still attached, are exposed to alternate increasing and decreasing pressure within the milling chamber as the rotor turns with the central shaft. Individual bran particles within the chamber are pressed together and caused to move relative to one another. The pressure with which bran particles are pressed together is regulated in part through the use of a device which restricts the discharge area of the milling chamber. The frictional rubbing action produced by this design removes smaller, aleurone-rich endosperm particles from the bran particles. Preferably, some of the surfaces of the milling rotor and/or the outer perforated cylinder are constructed of or coated with an abrasive material such as emery. Exposure to the abrasive surfaces within the chamber results in the scraping of endosperm, including aleurone, off of the bran particles to which they are attached. The detached endosperm particles, which are smaller than the bran particles, then pass through the perforations in the outer cylinder, while the bran particles remain inside the milling chamber and inside the outer perforated cylinder until eventually the bran particles, which now have significantly less endosperm and aleurone, are discharged due to the conveying action of the auger.

Resistance bars can be placed at intervals about the circumference of the outer perforated cylinder in another embodiment of the present invention. The rotor is eccentric, preferably having at least one lobe extending radially for the length of the rotor. Some surfaces of the rotor and/or the outer perforated screen are preferably constructed of or coated with an abrasive material such as emery. In this embodiment, several resistance bars, which extend the length of the outer perforated cylinder, are placed inside the outer perforated cylinder at intervals about its inner circumference. An irregular annular milling chamber is defined between the outer eccentric circumference of the rotor and the inner circumference of the outer perforated cylinder, which is non-circular due to a preferred polygonal shape and due to the resistance bars. The resistance bars impede the movement of the bran particles within the milling chamber. As the rotor is rotated by a motor-driven central shaft, bran particles within the cylinder move circumferentially in the same direction as the rotation of the milling rotor in addition to axially due to the conveyance of the auger. As the particles encounter the resistance bars, there is an increase in pressure due to the restriction of the area through which they must pass. Eccentric lobes on the rotor apply a compressive force to the bran particles as the bran particles squeeze through the annular milling chamber made thinner by the resistance bars. The bran particles are pressed together and rubbed against one another and against the resistance bars and the inner surface of the outer perforated cylinder. Once the particles pass the point of obstruction caused by the resistance bars, this relative motion is reversed. The pressure with which bran particles are pressed together is also regulated, to some degree, by a device which restricts the discharge area of the milling chamber. Consequently, individual bran particles within the chamber are pressed together and caused to move relative to one another. The frictional rubbing action produced by this design removes aleurone-rich endosperm particles from the bran particles. In addition, exposure to abrasive surfaces of the milling rotor results in the scraping of endosperm particles off of the bran particles to which they are attached. These detached endosperm particles then pass through the perforations in the outer cylinder, while the bran particles remain inside the outer perforated cylinder until eventually discharged out the top of the milling machine due to the conveying action of the auger.

Figure 5:
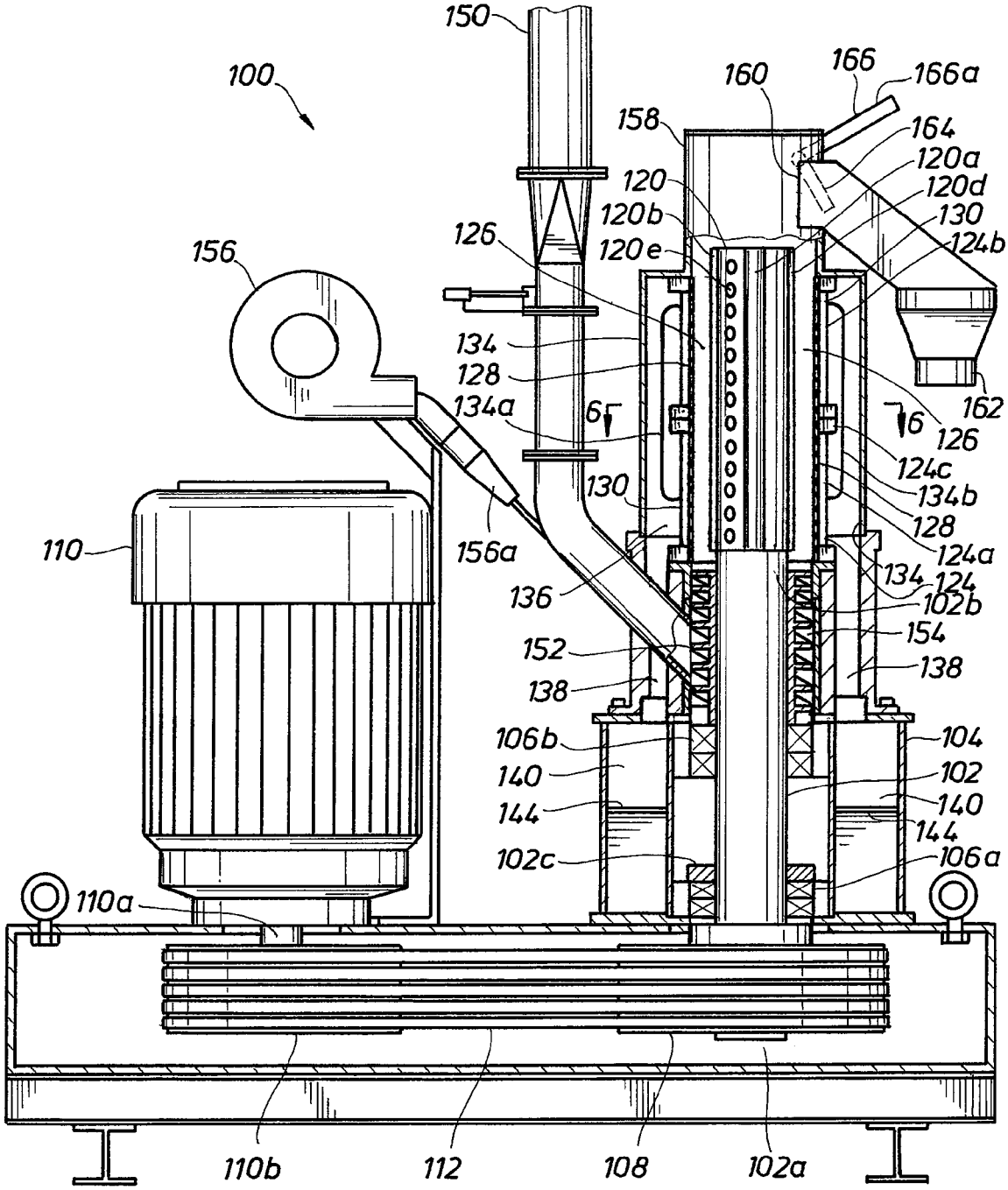
FIG. 5 is a side elevation in partial cross-section of a milling machine, according to the present invention.

FIG. 5 is a side elevation of a milling machine 100 in partial cross-section, which illustrates one embodiment of the present invention. Milling machine 100 comprises a shaft 102, which is oriented vertically and which is hollow and has the cylindrical shape of a pipe. Shaft 102 has a lower end 102*a* and an upper end 102*b*. Shaft 102 is received in a shaft support structure 104, and more particularly, shaft 102 is received in bearing assemblies 106*a*, which is located near lower end 102*a*, and 106*b*, which is located in a central position with respect to the length of shaft 102. Shaft 102 can be supported by a single bearing assembly located near its lower end 102*a*, but the two bearing assemblies 106*a* and 106*b* are illustrated in this embodiment. A flange 102*c* is fixed to shaft 102 and rests on bearing assembly 106*a* for providing vertical support for shaft 102. Alternatively, the diameter of shaft 102 can be reduced on lower end 102*a* to provide a shoulder on shaft 102 that can provide vertical support, which requires a suitable bearing assembly for carrying the weight of shaft 102 while providing nearly frictionless rotation. A shaft pulley 108 is fixed to the lower end 102*a* of shaft 102, and an electric motor 110 having a motor shaft 110*a* and a motor pulley 110*b* mounted to the motor shaft 110*a* rotates shaft 102 using belts 112.

Figure 6:
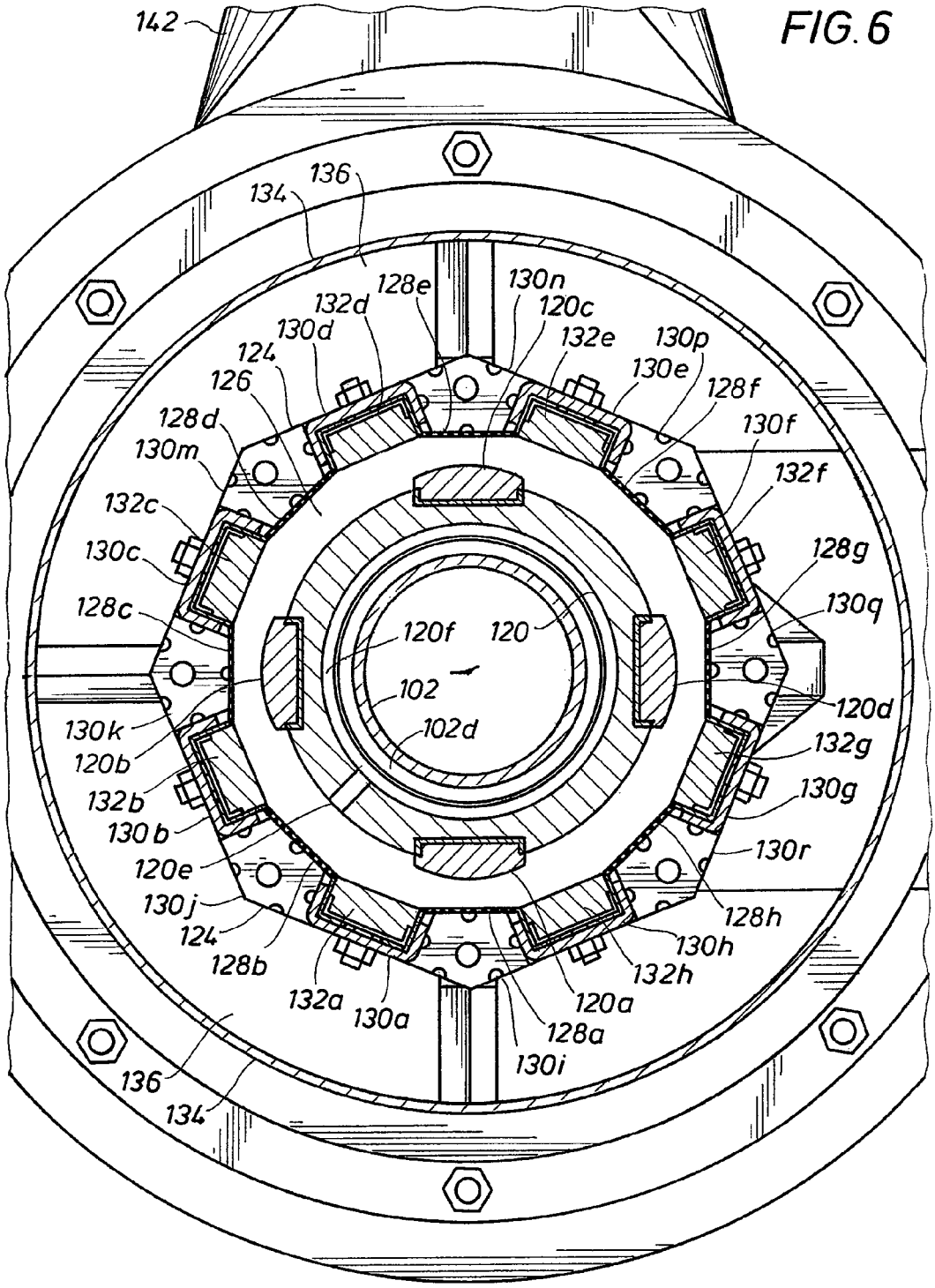
FIG. 6 is a cross-section of the milling machine of FIG. 5 as seen along the line 6-6.

A rotor 120 is removably attached to upper end 102*b* of shaft 102, and activation of motor 110 causes shaft 102 to rotate, which causes rotor 120 to rotate. Four lobes 120*a*, 120*b*, 120*c* (not shown) and 120*d* are attached to or formed integral with and extend the length of rotor 120. The lobes 120*a-d* extend radially outwardly from the outer surface of the rotor 120 and are spaced evenly around the circumference of the rotor 120. A frame assembly or basket 124 surrounds rotor 120 and is spaced radially outwardly from rotor 120 and has a lower portion 124*a* and an upper portion 124*b*, which are attached together through a flanged connection 124*c*. An outer surface of rotor 120 and lobes 120*a*, 120*b*, 120*c* and 120*d* and an inner surface of frame assembly 124 define an annular-shaped milling chamber 126. Frame assembly 124 has a perforated screen assembly 128, which provides a portion of the inner surface of frame assembly 124 that defines milling chamber 126. Frame assembly 124 has a holder assembly 130, and screen units are held to holder units as will become more clear with a description of a transverse cross-section provided in FIG. 6. A cylindrical housing 134 surrounds frame assembly 124. An inner surface of cylindrical housing 134 and an outer surface of frame assembly 124 define an annular flour chamber 136. Housing 134 has observation windows 134*a* and 134*b* for observing the flour chamber 136. Flour from milling chamber 126 passes through holes in screen assembly 128 and is initially collected in flour chamber 136. An annular flour passageway 138 is open to flour chamber 136 so flour falls downwardly from flour chamber 136 through the annular flour passageway 138 and is collected in a flour discharge hopper 140 before flowing out as product through a flour discharge outlet 142. Flour discharge outlet 142 is not shown in FIG. 5, but it is shown in FIG. 6. A sloped plate 144 provides a bottom or floor for flour discharge hopper 140 and directs the product flour toward the flour discharge outlet 142.

In operation, a bran is produced in a process for milling a cereal grain such as described with reference to FIG. 4, and the bran includes some endosperm. A layer of aleurone is adhered to the bran at least in the case where the cereal grain is wheat, and additional endosperm is adhered to the aleurone or in some manner associated with the bran, which is referred to herein as a flour-rich bran or an aleurone-rich bran. The flour-rich bran is fed into an inlet chute 150 in the milling machine 100 of FIG. 5 to a screw or auger 152 in an inlet chamber 154. Auger 152 is fixed to and rotates with shaft 102. Auger 152 conveys the flour-rich bran upwardly into the milling chamber 126. Rotor 120 rotates with shaft 102 and auger 152, and endosperm, such as aleurone and endosperm adhered to the aleurone, is detached and dislodged from the bran due to a milling action provided by the rotor 120 in combination with the frame assembly 124. A fan or blower 156 is connected by a duct 156*a* to inlet chute 150 and blows air into the inlet chamber 154. The air flows into the milling chamber 126 from the inlet chamber 154 and fluidizes the bran and the dislodged endosperm. A vacuum is drawn on the flour discharge outlet 142, which causes air to flow from the milling chamber 126 through the perforated screen assembly 128, through the flour chamber 136 and through the annular flour passageway 138 into the flour discharge hopper 140 and out through the flour discharge outlet 142. Due to the suction drawn at the flour discharge outlet 142, surrounding air is also drawn into the lower end 102*a* of shaft 102, which is open, through shaft 102, which is hollow, into rotor 120, which is hollow, and out through a plurality of holes 120*e*, which are shown as circles aligned longitudinally on rotor 120, and into the milling chamber 126. The air flowing through the milling chamber 126 and the perforated screen assembly 128 carries the endosperm that has been dislodged from the bran out of the milling chamber 126 through the perforated screen assembly 128 through the flour chamber 136 and through the annular flour passageway 138 into the flour discharge hopper 140 and out through the flour discharge outlet 142. Blower 156 or a different blower can also blow air into hollow shaft 102, and such air would flow into rotor 120 and out through the plurality of holes 120*e*.

The conveying action of auger 152 pushes the bran upwardly, while the milling action of rotor 120 dislodges endosperm, which is carried out of the milling chamber 126 through screens 128 into the flour chamber 136 and out through the annular flour passageway 138. The conveying action of auger 152 continues to push the bran upwardly, and the bran becomes more depleted of endosperm as it passes upwardly through milling chamber 126 due to milling action. The bran, which has a diminished amount of endosperm, is discharged out the top of the milling chamber 126 into a bran discharge hopper 158 and out of milling machine 100 through a bran discharge opening 160 into a bran discharge chute 162. A gate 164 can cover bran discharge opening 160 for restricting the flow of bran out of the bran discharge hopper 158 for adjusting back pressure in the milling chamber 126. Gate 164 is pivotably connected to a lever 166, and a downward force, such as by adding a weight, can be applied to an outer end 166*a* of lever 166 for restricting the flow of bran through the bran discharge opening 160. The flour-poor bran discharged through bran discharge chute 162 after endosperm is removed from the bran and recovered through bran discharge chute 162 is referred to herein as flour-poor bran or as aleurone-poor bran. Flour-rich bran is fed into milling machine 100, which processes the flour-rich bran and produces a flour product and a flour-poor bran product. If wheat, in particular, is used as the cereal grain in this milling process, then the flour product may be referred to as an aleurone-rich flour product because aleurone is dislodged and recovered from the aleurone rich bran thereby producing an aleurone-depleted bran product.

FIG. 6 is a cross-section of milling machine 100 as seen along the line 6-6 in FIG. 5, which is through rotor 120 and frame assembly 124. One is looking down at a cross-section of rotor 120 and frame assembly 124. Although rotor 120 can be a solid object, in this embodiment rotor 120 has a hollow center or longitudinal bore like a pipe. Shaft 102 has an outside reinforcing shoulder 102*d*, which has a greater diameter than shaft 102 and which has male threads on an outer surface. Rotor 120 has an inside reinforcing shoulder 120*f*, which has a smaller diameter than rotor 120 and which has female threads on an inside surface for a threaded engagement with the male threads on shaft reinforcing shoulder 102*d*, thereby removably fastening rotor 120 to shaft 102. The outer surface of rotor 120 has four channel slots essentially the full length of rotor 120 that have been milled out of the outer surface of rotor 120, and lobes 120*a*, 120*b*, 120*c* and 120*d* are located inside the channel slots.

Frame assembly or basket 124 is spaced radially outwardly from the outer circumference of rotor 120 and lobes 120*a-d*. Milling chamber 126 is defined by the outer surface of rotor 120 and lobes 120*a-d* and the inner surface of frame assembly 124. Rotor 120 and lobes 120*a-d* do not protrude into milling chamber 126 and instead provide a boundary wall that defines an innermost annular surface of milling chamber 126. The shape or configuration of the innermost annular surface of milling chamber 126 varies as the lobes 102*a-d* rotate with shaft 102, thus varying the thickness of annular milling chamber 126. In cross-section, the inside surface of frame assembly 124 is generally circular, but is actually comprised of multiple straight-line segments, so the transverse cross-section in FIG. 6 of frame assembly 124 at its inside surface is a polygon.

Frame assembly 124 has a number of different parts or components. The perforated screen assembly 128 comprises perforated U-shaped channels 128*a*, 128*b*, 128*c*, 128*d*, 128*e*, 128*f*, 128*g* and 128*h*. The term "U-shape" denotes that a transverse cross-section of channels 128*a-h* is generally rectangular with one long side open or missing. Holder assembly 130 comprises U-shaped channels 130*a*, 130*b*, 130*c*, 130*d*, 130*e*, 130*f*, 130*g* and 130*h*. The U-shaped channels 130*a-h* extend essentially the full length of frame assemble 124. The U-shaped channels 130*a-h* are held together by four or more horizontal rows of supports 130*i*, 130*j*, 130*k*, 130*m*, 130*n*, 130*p*, 130*q* and 130*r*. The supports, such as 130*i*, have a five-sided or pentagon shape in the plan view of FIG. 6. The supports are typically cast into the basket or frame assembly 124. Abrasive inserts 132*a*, 132*b*, 132*c*, 132*d*, 132*e*, 132*f*, 132*g* and 132*h* are received in U-shaped channels 130*a*, 130*b*, 130*c*, 130*d*, 130*e*, 130*f*, 130*g* and 130*h*, respectively. Each of the perforated U-shaped channels 128*a-h* of screen assembly 128 has a flange on each side of the channel that extends outwardly parallel with the long side of a transverse cross-section of perforated channels 128*a-h*. These flanges are received in the U-shaped channels 130*a-h* and held in place by the abrasive inserts 132*a-h*. With reference to FIG. 6, for example, perforated screen 128*b* has one flange beneath abrasive insert 132*a* in U-shaped channel 130*a* and an opposing flange beneath abrasive insert 132*b* in U-shaped channel 130*b*. Threaded studs are embedded in abrasive inserts 132*a-h* and pass through openings in U-shaped holder channels 130*a-h*, and a washer and threaded nut is placed on each stud for fastening the abrasive inserts 132*a-h* to the U-shaped holder channels 130*a-h*, which holds the perforated screens 128*a-h* in place because the wing flanges on the perforated screens 128*a-h* are held between the abrasive inserts 132*a-h* and the U-shaped abrasive insert holders 130*a-h*. Housing 134 surrounds frame assembly 124, and the annular flour receiving chamber 136 is between frame assembly 124 and housing 134.

As flour-rich bran is introduced to the milling chamber 126, rotor 120 rotates and lobes 120*a-d* compress the flour-rich bran as they pass the bran, and the bran decompresses momentarily after one of the lobes 120*a-d* has passed. Auger 152 (FIG. 5) maintains an inlet pressure on the bran, and the weighted gate assembly 164 and 166 (FIG. 5) maintain an outlet pressure on the bran as the bran rises through milling chamber 126. Milling chamber 126 is thus operated at a pressure higher than atmospheric pressure. The non-circular, polygonal shape of the inside of the frame assembly 124 also assists in the compression and decompression of the bran because the bran is compressed the most while the distance between the lobes 120*a-d* is the least, and the bran is compressed the least while the distance between the lobes 120*a-d* is the greatest. The rotation of rotor 120 thus causes a compression-decompression cycle for the bran, which causes the bran to rub together, thus dislodging endosperm and aleurone-type endosperm from the bran due to friction forces. A further milling action involves the abrasive inserts 132*a-h*, which scrape endosperm and aleurone-type endosperm off of the bran. The bran is rubbed against the abrasive surface of the abrasive inserts 132*a-h* as the bran is conveyed upwardly by auger action, as the bran is rotated by rotary action and as the bran is squeezed against the abrasive surface and then released slightly by eccentric lobe action. The abrasive surfaces of the abrasive inserts 132*a-h* rub and scrape endosperm and aleurone-type endosperm off of the bran as the bran is forced to slide along the abrasive surfaces. The compression-decompression cycle forced on the bran as the protruding lobes 120*a-d* slide over the bran causes the bran to move radially outwardly and inwardly, thereby ensuring that a significant portion of the bran particles come into contact with the abrasive surfaces of the abrasive inserts 132*a-h*. The eccentricity of rotor 120, due to lobes 120*a-d*, causes turbulence in the flow of the bran through the milling chamber 126, thus rubbing bran particles together and moving different bran particles into contact with the abrasive inserts 132*a-h*. The eccentricity of rotor 120 helps to avoid a laminar flow of the same bran particles staying in contact with the abrasive inserts 132*a-h* as the bran is conveyed upwardly by auger action. Lobes 120*a-d* can also have an abrasive surface for additional scraping action. Eccentricity of rotor 120 could alternatively be introduced by using a rotor that has a non-circular cross-section or by mounting a rotor on a shaft in a manner such that the longitudinal axis of the rotor is not coaxial with the longitudinal axis of the shaft. Any combination of lobes, non-circular cross-section and non-aligned axes can be used to introduce an eccentric rotation of the rotor for radially pressing the bran particles together and against the inner surface of the frame assembly 124.

Milling machine 100 is used in bran finishing for increasing the yield or recovery of flour, and particularly in the case of wheat, for recovery of nutrient-rich aleurone, which can be added to flour to give the flour much of the nutrition of whole wheat while maintaining the taste and appearance of conventional white flour. Comparing milling machine 100 of FIGS. 5 and 6 to the prior art bran finisher 30 of FIG. 2, a key difference is that the beater bars 38*a-e* in prior art FIG. 2 pass through the bran in the trough or cover 40 and thus are within the milling chamber 42, while the rotor 120 and its lobes 120*a-d* do not pass through the bran and instead form an impermeable boundary wall that defines an inner side of an annular milling chamber. The beater bars 38*a-e* and the spokes 36*a-e* are immersed in bran particles within the milling chamber 42 in the prior art bran finisher 30 of FIG. 2. There may be some rubbing of bran particles together and against cover trough 40 as the beater bars 38*a-e* rotate through the bran particles. However, prior art bran finisher 30 operates with much lower internal pressure on the bran, and consequently, there is minimal friction milling action in prior art bran finisher 30 as compared to milling machine 100 of the present invention.

Prior art bran finisher 30 relies primarily on impact forces as the beater bars 38*a-e* collide with bran particles in milling chamber 42 in cover trough 40 to dislodge endosperm from the bran particles. In the case of wheat, since aleurone is adhered to the bran, the impact and friction forces in prior art bran finisher 30 of FIG. 2 are too weak to dislodge or detach a significant amount of aleurone from the bran particles. Consequently, the aleurone has been lost in the bran product rather than recovered as a flour product, and bran is valued significantly lower than flour. Milling machine 100 of the present invention does not rely on impact forces and instead relies to a great extent on the compression-decompression cycle caused by rotor lobes 120*a-d* to induce frictional forces for rubbing endosperm and aleurone-type endosperm off of the bran particles. Milling machine 100 of the present invention also relies on abrasive action achieved as bran particles are forced to rub against the abrasive surfaces of abrasive inserts 132*a-h*.

Another difference between the prior art bran finisher 30 of FIG. 2 and the inventive milling machine 100 of FIGS. 5 and 6 is in the milling chambers that each machine has. Prior art bran finisher 30 is not run full, although bran particles would be splashed within the space defined by cover or trough 40 and into the upper portion 32*c* of housing 32. If all of this cross-sectional space is consider to be milling chamber 42, then the prior art milling chamber 42 has a lower portion defined by a circular arc of about 220 degrees and an upper portion defined by five straight sides. Shaft 34 may pass through the prior art milling chamber 42, depending on how full milling chamber 42 is filled with bran. It is believed that most people skilled in this art would consider prior art bran finisher 30 full if bran is filled to slightly below the level of shaft 34 if the milling machine were viewed while not in operation. In this case, prior art milling chamber 42 has a generally semi-circular cross-section. In contrast, milling chamber 126 of the present invention described with reference to FIGS. 5 and 6 has an annular shape in a transverse cross-section, albeit a somewhat irregular annular shape since lobes 120*a-d* disrupt the circular shape of rotor 120 and the inner surface of frame assembly 124 is polygonal in shape. The milling chamber 126 of the present invention runs full, and the bran particles are kept under a pressure that is significantly greater than atmospheric pressure, when measured in inches or centimeters of water. Prior art milling chamber 42 operates at essentially atmospheric pressure. Prior art bran finishers operate at a low fill level, which is required to get the impact affect of the beaters hitting the bran and the bran hitting the screen. The milling chamber of a prior art bran finisher is exposed to ambient pressure conditions, whereas the bran in milling chamber 126 of the present invention is exposed to the pressure of the weight of the material in milling chamber 126 plus any additional pressure caused by resistance applied at the discharge gate 164, such as by placing weight on lever 166. Prior art bran finishers do not have a mechanism for increasing resistance at the discharge gate for putting a back pressure on the milling chamber. In the present invention, a vacuum is applied to the flour discharge outlet 142, typically ranging from 6 to 50 inches of water vacuum, for assisting in flour fines removal and for cooling the bran, flour and machine parts. Prior art bran finisher 30 does not have a vacuum applied to its discharge outlet. Air is not forced into prior art bran finisher 30, which is unlike milling machine 100 of the present invention because blower 156 forces air into milling chamber 126 by way of feed screw 152 and/or through shaft 102 and the plurality of openings 120*e* in rotor 120. Blower 156 may deliver air at a pressure of 6 to 12 inches of water. Although air is blown into the milling machine of the present invention and a vacuum is drawn on the flour discharge outlet, the product-to-air ratio in the milling chamber of the present invention is quite high in comparison to prior art bran finishers in which the product-to-air ratio is quite low.

Milling machines that are very similar to milling machine 100 of the present invention have been used for other purposes. U.S. Pat. No. 5,211,982, issued to Wellman and incorporated by reference, discloses a bran removal machine that is similar to milling machine 100 of the present invention. In the Wellman '982 patent, wheat is fed into a milling chamber, and bran is removed, which passes through perforated screens, and pearled wheat is recovered from an outlet chute at the top of the machine. Milling machine 100 differs from the debranning machine in the Wellman '982 patent primarily in that the holes in the perforated screens are different. In the prior art use that Wellman describes, bran needs to flow through screens 50 in Wellman's FIG. 3B. The holes in this prior art application are likely to be elongated slots through which bran will pass. The holes in screens 128 of the present invention are generally round, although a polygon shape is suitable, are not elongated and have a diameter of less than about 5 mm or less than about 4 mm or preferably less than or equal to about 3 mm, and in some applications a maximum hole diameter of about 2 mm may be adequate. A principle in the prior art Wellman '982 patent was that bran should pass through perforated screens that define the milling chamber, while pearled wheat should be conveyed by auger action out the top of the milling machine. A principle in the present invention is that endosperm, aleurone-type endosperm and/or flour should pass through perforated screens 128 in FIGS. 5 and 6, which partially define the milling chamber 126, while flour-poor or aleurone-depleted bran should be conveyed by auger action out the top of the milling machine 100.

The milling machine 100 of the present invention thus differs from prior art bran removal machines, such as described in the Wellman '982 patent, primarily in the screen hole size and shape, but the use of the milling machine for bran finishing is a very significant difference from a point of view that concerns a milling process. In a conventional prior art milling process, the prior art bran finisher 30 described with reference to FIG. 2 has been a standard in the milling process. The impact force imparted by prior art bran finisher 30 has been the established and accepted norm for recovering endosperm from bran in a bran finishing step. Milling machine 100 of the present invention deviates significantly from the norm in that it uses relatively strong frictional and abrasive forces for recovering endosperm, including aleurone-type endosperm, from bran in a bran finishing step.

Manufacturers that are believed to be capable of providing a milling machine suitable for use in the process of the present invention include Super Brix of Barranquilla, Colombia, particularly its SBN-1 NutriMill Abrasive/Friction, ABX Top-Fed Abrasive, AFX Bottom-Fed Friction, PV Bottom-Fed Abrasive/Friction and PHB Horizontal Friction models; Satake of Saijo, Japan, particularly its VTA Top-Fed Abrasive, VBF Bottom-Fed Friction and KB40 Horizontal Friction models; Buhler of Uzwil, Switzerland, particularly its Whitener—Topwhite Model BSPB; and Golfetto Sangati of Treviso, Italy, particularly its PSV Debranner model.

Other machines and/or processes have been described in the prior art for recovering aleurone from bran. The prior art for recovering aleurone as exemplified by U.S. Pat. No. 4,746,073 and U.S. Patent Application Pub. Nos. 2003/0175384 and 2006/0177529, which are discussed above, is believed to employ milling machines for both detachment of aleurone from bran and grinding or otherwise breaking the bran and aleurone into small particles of aleurone and non-aleurone bran components that are mixed together, which is followed by separating the aleurone from the non-aleurone bran components by various methods including electrostatic separation and air classification. The present inventors believe that the identified prior art requires breaking or grinding the bran and aleurone into small particles that are mixed together, which requires separation of the small particles of aleurone and non-aleurone bran components into two product streams, one of which is rich in aleurone and the other of which is rich in non-aleurone bran components.

The present inventors believe that traditional bran finishers, exemplified in FIG. 2, are not as effective as the present invention for recovering residual endosperm and aleurone from bran. In addition, other prior art methods used for recovering aleurone from bran, exemplified in U.S. Pat. No. 4,746,073, issued to Stone et al., require additional steps, such as grinding or breaking the bran and aleurone into small particles that are mixed together and further processing for separating the mixture of small particles into an aleurone product and a non-aleurone bran product. The present invention instead detaches the aleurone from the bran and effectively separates the aleurone-rich flour from the aleurone-depleted bran components in a single milling machine. The present inventors believe that the increased effectiveness of the present invention for recovering residual endosperm and aleurone from bran can reduce the number of machines required earlier in the milling process. It is further believed that prior art methods exemplified by the Stone '073 patent produce a darker colored flour product than the method of the present invention, because much of the bran is ground into flour-sized particles in the prior art methods exemplified by the Stone '073 patent. The bran that is ground into flour-sized particles in the prior art methods is recovered with the flour product, and consequently, the flour product has a darker color due to the bran content.

The milling process of the present invention offers a number of benefits. The inventive milling process can require less capital outlay and less space to build a mill, and the milling process can be operated at a lower cost than a prior art milling process due to the potential to shorten the traditional mill break and bran finishing system. The endosperm recovered, which is rich in aleurone, is rich in nutrients, making possible the production of value-added products such as light-colored flour that has many of the nutritional characteristics of whole grain flour. In addition, a prior art requirement for tempering, which is largely controlled by a need to condition bran and germ for a traditional milling process, results in the final bran product having a relatively high moisture content (approximately 14%), which affects the value of the bran product, if the bran product is used directly as a fuel, or if further processing of the bran requires moisture levels below 14% such as for size reduction. The methodology used in the present invention inherently dries the bran that is produced because the friction that results as bran particles go through compression and decompression, which rubs the particles together, generates heat that dries the bran, and moisture is carried away by air flowing through the milling chamber. Thus, the present invention offers the potential for increasing the tempering moisture content to be used in the traditional reduction processes, without increasing the final moisture content in the bran. An increase in tempering moisture content should increase the efficiency of milling processes upstream of the milling machine of the present invention, while the process of the present invention produces a bran that is much drier than the typical 14% moisture content found in bran from a prior art process because the bran is dried as endosperm and aleurone-type endosperm are removed from the bran in the milling machine of the present invention.

The combined abrasive scraping and rubbing actions that are applied to the bran particles by the present invention produce a more effective removal of endosperm from the bran than can be accomplished using traditional methods. As a result, higher yields of endosperm products such as flour and bio-fuel feed stocks can be obtained than is possible using traditional methods with the same number of steps, or, alternatively, endosperm yields similar to those of traditional cereal milling can be achieved with fewer impact or roller-milling stages, resulting in a shorter milling system, which requires less capital and involves lower operating costs. Additionally, the endosperm recovered by the invention, being rich in aleurone, is also rich in nutrients, making possible the production of value-added products such as light-colored flour that has many of the nutritional characteristics of whole grain flour.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A process for recovering aleurone from bran, comprising the steps of:

(a) processing wheat to produce flour and a first bran stream, wherein the first bran stream comprises bran and an aleurone-rich flour adhered to the bran;

(b) feeding the first bran stream to a milling machine, wherein the milling machine comprises:

a housing;

an elongated shaft received in the housing;

a rotor fixed to the shaft, wherein the rotor has a length and a radial-outermost surface along its length; and a frame assembly received in the housing, wherein the frame assembly has a plurality of holes, wherein a milling chamber is defined between the radial-outermost surface of the rotor and the frame assembly, wherein the radial-outermost surface of the rotor provides a boundary wall for the milling chamber, wherein the housing has an inlet opening for receiving the first bran stream into the milling chamber, and wherein the housing has first and second discharge outlets;

(c) operating the milling machine such that the shaft rotates thereby rotating the rotor thereby dislodging a portion of the aleurone-rich flour from the bran;

(d) recovering an aleurone-rich flour product from the milling chamber through the plurality of holes in the frame assembly and through the first discharge outlet; and (e) recovering a second bran stream from the milling chamber through the second discharge outlet.

2. The process of claim 1, wherein the frame assembly has a length, is generally cylindrical in shape and has a radial-innermost surface, wherein the frame assembly surrounds the rotor, wherein the milling chamber comprises an annular space defined between the radial-outermost surface of the rotor and the radial-innermost surface of the frame assembly.

3. The process of claim 2, wherein a transverse cross-section of the frame assembly has the shape of a polygon along the radial-innermost surface of the frame assembly.

4. The process of claim 1, wherein the frame assembly comprises frame parts and screen parts, wherein the frame parts and screen parts form a hollow cylindrical shape while assembled, wherein the cylindrical shape has a transverse cross section that is circular or non-circular, wherein the frame assembly surrounds the rotor, wherein the plurality of holes in the frame assembly is located in the screen parts, and wherein the plurality of holes comprise screen holes, wherein the screen holes are generally circular and/or polygonal in shape and have a diameter of less than about 4.0 mm.

5. The process of claim 1, wherein the plurality of holes comprise milling chamber discharge ports, and wherein the milling chamber discharge ports are generally circular and/or polygonal in shape and have a diameter of less than about 3.0 mm.

6. The process of claim 5, wherein the milling chamber discharge ports have a diameter of less than or equal to about 2.0 mm.

7. The process of claim 1, wherein the frame assembly has essentially the shape of a hollow cylinder, wherein the shape of a transverse cross-section of the frame assembly may be circular or non-circular or polygonal, wherein the frame assembly surrounds the rotor, wherein a transverse cross-section of the milling chamber has a ring shape, wherein the ring shape may be circular or non-circular or polygonal, and wherein the rotor has at least one lobe that protrudes radially outwardly along the length of the rotor.

8. The process of claim 1, wherein the frame assembly has a length that is about as long as the length of the rotor, wherein the frame assembly has a longitudinal axis and a bore along its longitudinal axis that extends the length of the frame assembly, wherein the rotor is received in the bore, wherein the frame assembly has a radial-innermost surface that defines a radial-outermost surface of the milling chamber, and wherein the radial-innermost surface of the frame assembly defines a generally-circular shape in a transverse cross section of the frame assembly.

9. The process of claim 8, wherein the generally-circular shape defined by the radial-innermost surface of the frame assembly in a transverse cross section of the frame assembly comprises multiple straight-line portions.

10. The process of claim 1, wherein the second bran stream is discharged from the milling chamber without passing through the plurality of holes in the frame assembly.

11. The process of claim 1, wherein the rotor comprises components that, while assembled and fixed to the shaft, comprise essentially a cylinder, wherein the cylinder may be solid or may have a hollow longitudinal bore, wherein a transverse cross-section of the rotor may or may not have the shape of a circle along the radial-outermost surface of the rotor, and wherein the radial-outermost surface of the rotor may have an irregular shape.

12. The process of claim 11, wherein the rotor comprises at least one lobe that projects radially outwardly, and wherein the at least one lobe extends essentially the length of the rotor.

13. The process of claim 12, wherein the at least one lobe has an outer surface that partially defines the milling chamber, and wherein the outer surface of the at least one lobe is abrasive for scraping the aleurone-rich flour from the bran.

14. The process of claim 1, wherein at least a portion of the surfaces that define the milling chamber is an abrasive surface for scraping the aleurone-rich flour from the bran.

15. The process of claim 1, wherein the rotor comprises an assembly of rotor parts, wherein the rotor parts include a plurality of abrasive rollers, and wherein the abrasive rollers have an abrasive outer circumferential surface that partially defines the milling chamber.

16. The process of claim 1, wherein the frame assembly has a length that is about as long as the length of the rotor, wherein the frame assembly surrounds the rotor, wherein the frame assembly has a radial-innermost surface that defines a radial-outermost surface of the milling chamber, wherein a transverse cross section of the frame assembly has a generally-circular shape defined by the radial-innermost surface of the frame assembly, wherein the generally-circular shape comprises multiple straight-line portions, and wherein the rotor has a lobe that projects radially outwardly along its length.

17. The process of claim 1, further comprising flowing air through the housing.

18. The process of claim 17, wherein the air flows into and through the milling chamber and out through the plurality of holes for removing the aleurone-rich flour from the milling chamber.

19. The process of claim 18, wherein the rotor has a bore along its longitudinal axis, wherein the rotor has radial openings, and wherein the air flows into the bore and out through the radial openings into the milling chamber.

20. The process of claim 1, wherein the rotor has one or more radial projections extending essentially the length of the rotor that partially define the radial-outermost surface of the rotor unit, or wherein the rotor comprises a plurality of rotor parts, wherein the rotor parts include a plurality of abrasive rollers and a plurality of plates that have radially-extending spokes.

21. A process for finishing bran, comprising the steps of:

(a) processing grain;

(b) recovering aleurone-rich bran from the grain, wherein the aleurone-rich bran comprises aleurone components adhered to bran components;

(c) processing the aleurone-rich bran in a milling machine, wherein the milling machine has a rotor assembly, wherein the rotor assembly has a length, an irregular cylindrical shape and a radial outermost surface along its length, wherein the milling machine has a basket assembly that has an open central longitudinal portion in which the rotor assembly is received, wherein a milling chamber is defined between the radial outermost surface of the rotor assembly and the basket assembly for receiving the aleurone-rich bran, wherein the basket assembly includes a screen with openings, wherein the milling machine detaches a portion of the aleurone components from the bran components by compressing the aleurone-rich bran and/or by scraping the aleurone components off of the bran components while the aleurone-rich bran is in the milling chamber;

(d) separating the aleurone components from the bran components with the milling machine by passing the aleurone components through the openings in the screen in the basket assembly;

(e) recovering the aleurone components from the milling machine; and (f) recovering the bran components from the milling machine without passing a significant amount of the bran components through the openings in the screen in the basket assembly.

22. A process for recovering aleurone from grain, the grain comprising endosperm, aleurone and bran, the process comprising the steps of:

separating a major portion of the endosperm from the aleurone and bran;

recovering a bran stream that is rich in aleurone, wherein the aleurone is generally attached to the bran;

providing a milling machine that has a rotor unit and a screen unit spaced from the rotor unit, wherein the rotor unit has a radial-outermost surface, wherein a milling chamber is defined between the radial-outermost surface of the rotor unit and the screen unit, and wherein the screen unit has a plurality of holes;

feeding the bran stream into the milling chamber;

detaching a portion of the aleurone from the bran inside the milling chamber by squeezing the bran stream between the rotor unit and the screen unit and/or by scraping the aleurone off of the bran, thereby forming a mixture comprising an aleurone product and a bran product; and recovering the aleurone product from the milling chamber through the plurality of holes in the screen unit.

23. The process of claim 22, wherein the rotor unit comprises a shaft and a rotor assembly attached to the shaft, and wherein the rotor assembly does not comprise a plurality of spaced-apart hubs having spokes for supporting beater plates.

24. The process of claim 22, wherein the milling chamber has an inlet opening through which the bran stream is received and an outlet opening, further comprising recovering the bran product through the outlet opening without the bran product passing through the plurality of holes in the screen unit.

25. The process of claim 24, wherein the screen unit has an irregular cylindrical shape, wherein the screen unit surrounds the rotor unit, and wherein the milling chamber has an irregular annular shape, further comprising flowing air through the milling chamber for assisting in separating the aleurone product from the bran product.

26. The process of claim 25, wherein the milling machine has an auger, wherein rotation of the auger provides a force for moving the bran stream into the milling chamber, and wherein a vacuum is drawn outside the screen unit.

27. The process of claim 22, wherein the rotor unit has at least one lobe that extends radially outwardly, wherein the screen unit has a plurality of relatively flat and elongated sides arranged to form an inside surface having a transverse cross-section that is generally, but not absolutely, circular in shape, and wherein rotation of the rotor unit presses the bran stream between the at least one lobe and the inside surface of the screen unit for detaching the aleurone from the bran.

28. The process of claim 22, wherein the milling machine has an inlet opening through which the bran stream is received into the milling chamber and a outlet chute through which the bran product is discharged from the milling chamber, wherein the milling machine has a hinged flapper over the outlet chute and a weight on the flapper, and wherein the pressure in the milling chamber can be controlled.

29. The process of claim 22, wherein the shape of the holes in the plurality of holes in the screen unit is generally circular and/or polygonal and is not generally elongated.

30. The process of claim 29, wherein the holes in the plurality of holes in the perforated screen have a diameter of less than or equal to about 3 mm.

31. The process of claim 22, wherein a transverse cross-section of the milling chamber has a ring shape, and wherein the ring shape does not have a uniform thickness.

32. The process of claim 22, wherein at least a portion of the surfaces that define the milling chamber is abrasive for scraping the aleurone off of the bran.

33. The process of claim 32, wherein the rotor unit comprises abrasive rollers.

34. The process of claim 22, wherein the grain is rye, barley, wheat, durum, durum wheat, hard wheat, soft wheat, triticale or a combination thereof.

35. The process of claim 22, wherein the grain is wheat.

36. A process for reducing the amount of endosperm, including aleurone, in a bran stream recovered from a cereal-grain milling process, wherein the bran stream comprises bran components and endosperm components adhered to the bran components, the process comprising the steps of:

feeding the bran stream into a milling machine that has a rotor unit and a screen unit surrounding the rotor unit, wherein the rotor unit has an irregular cylindrical shape and a radial-outermost surface, wherein a milling chamber having an irregular annular shape is defined between the screen unit and the radial-outermost surface of the rotor unit, and wherein the screen unit has a plurality of holes;

detaching a portion of the endosperm components from the bran components inside the milling chamber by squeezing the bran stream between the rotor unit and the screen unit and/or by scraping the endosperm components off of the bran components, thereby forming a mixture comprising an endosperm product and a bran product;

recovering the endosperm product from the milling chamber through the plurality of holes in the screen unit; and recovering the bran product from the milling chamber, wherein the bran product does not pass through the plurality of holes in the screen unit.

* * * * *